United States Patent [19]

Bessey et al.

[11] Patent Number: 4,989,437

[45] Date of Patent: Feb. 5, 1991

[54] METHOD AND APPARATUS FOR EXTRUDING METAL

[75] Inventors: Guy Bessey, Auvers sur Oise; Alain Noterman, Puiseux en France, both of France

[73] Assignee: Clecim, Cergy Pontoise, France

[21] Appl. No.: 312,996

[22] Filed: Feb. 21, 1989

[30] Foreign Application Priority Data

Feb. 19, 1988 [FR] France ..... 88 02035

[51] Int. Cl.[5] ..... B21C 35/04

[52] U.S. Cl. ..... 72/254; 72/270

[58] Field of Search ..... 72/253.1, 254, 255, 72/273.5, 270

[56] References Cited

U.S. PATENT DOCUMENTS 3,563,079 2/1971 Monie et al. .
3,630,064 12/1971 Mahns ..... 72/273.5
3,810,379 5/1974 Schlogelhofer ..... 72/255

FOREIGN PATENT DOCUMENTS 2404119 3/1976 Fed. Rep. of Germany .
2148704 3/1973 France .
2305249 10/1976 France .

*Primary Examiner*—Lowell A. Larson
*Attorney, Agent, or Firm*—Pollock, Vande Sande & Priddy

[57] ABSTRACT

A method and apparatus for extruding metal using the reverse method in which a billet placed in the bore of a container is compressed between a base and an extruding block. Billets are extruded in the raw state without prior removal of the outer layer, leaving a play sufficient to form a sleeve of a thickness at least equal to that of the outer layer to be removed, between the periphery of the block and the inner face of the bore, along the inner face. The bore is then scraped, using a scraping block whose periphery is separated from the inner face of the bore by a play which is less than the thickness of the sleeve but sufficient for the sleeve to be removed over a part only of its thickness.

15 Claims, 5 Drawing Sheets

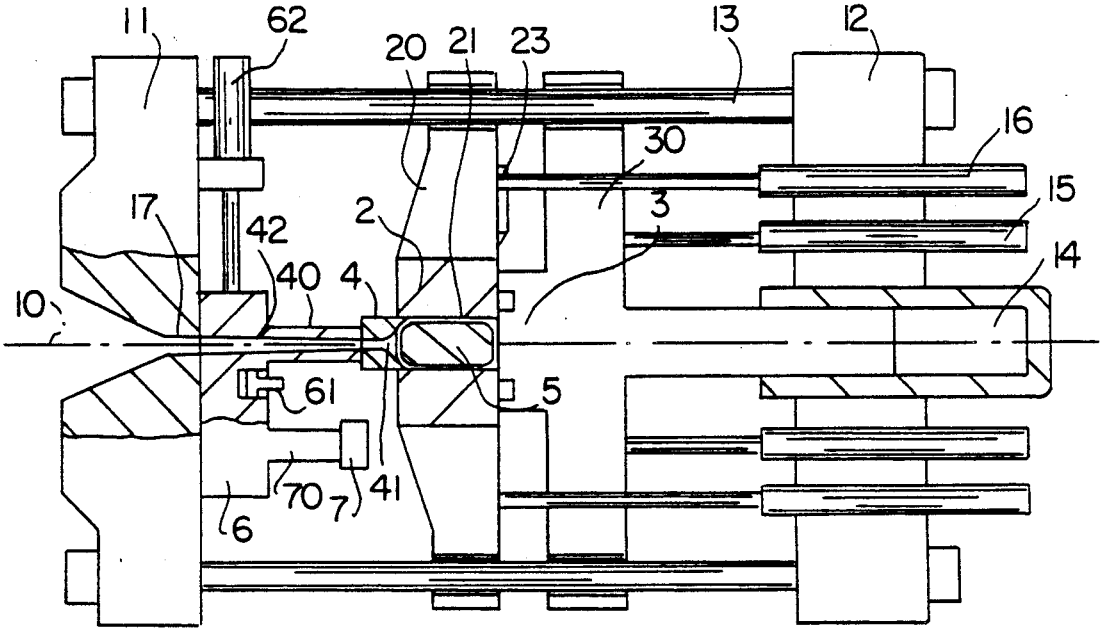
FIG. 1
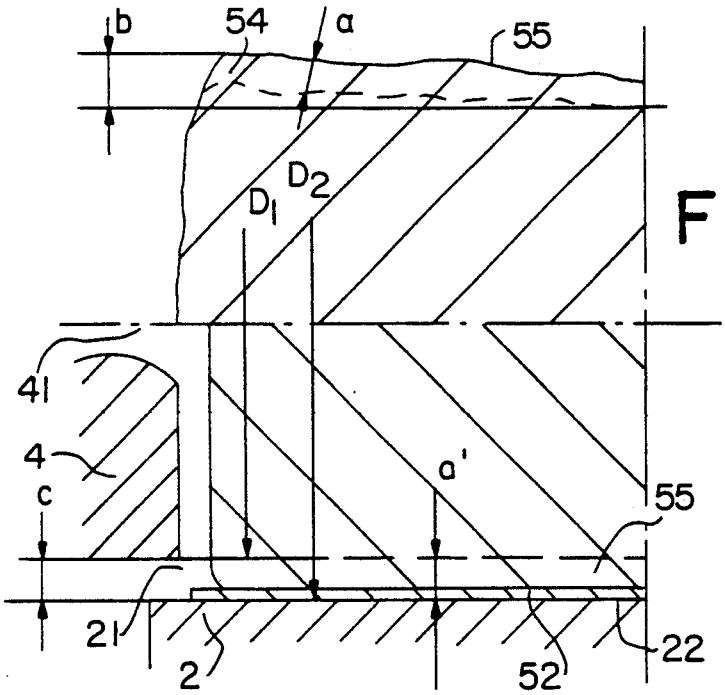
FIG. 2
FIG. 3

METHOD AND APPARATUS FOR EXTRUDING METAL

FIELD OF THE INVENTION

The invention relates to a method for extruding metal using the reverse method which is especially applicable to the extrusion of aluminum and alloys thereof, and it also covers an improved extrusion press for implementing the method.

BACKGROUND OF THE INVENTION

It is known that, when extruding metal using reverse method, the various layers of the extruded billet are substantially found in the extruded product, from the outside inwards. In particular, the outer layer of the billet appears, after extrusion, on the surface of the extruded products.

In point of fact, the surface of metal billets for extrusion originating from foundries normally exhibits surface defects, such as casting skin, segregation of alloy or addition elements, cold shot, etc. These defects may be found over a certain thickness which may be, for example, of the order of 2 mm starting from the outer face of the billet.

It has always been assumed that, before introducing the billet to be extruded into the container, it was necessary to remove the outer layer likely to contain the surface defects.

In a first known method, this removal is achieved via a peeling operation on a lathe. This method is effective but obviously increases production costs and requires turning installations for preparing the billets. In another method, the outer layer is removed by scalping, causing the billet to pass over blades which plane the outer surface over the desired thickness. This method is more rapid than peeling, but it must be performed in the hot state using a special device placed either between the furnace for heating the billets and the extruding press or directly on the press.

These two methods make it possible to obtain good surface quality for the billets, but present certain disadvantages. Firstly, the thickness of metal to be removed must take into account the geometric tolerances over the diameter, surface roughnesses, the thickness of the outer layer exhibiting structural defects and the precision of the preparation device, and the result of this is that a relatively large thickness, which may range up to 10 mm, has to be removed this involves a considerable percentage of waste before loading in the press. In point of fact, fire loss when resmelting the waste from turning is very considerable.

SUMMARY OF THE INVENTION

The invention obviates these drawbacks by means of a method which makes it possible to dispense with the preliminary treatment for removing the outer layer and, consequently, to simplify the installation which need no longer include additional devices provided for this purpose.

Generally, the invention applies to a method for extruding metal using the reverse method, i.e., in which a metal billet, placed in a bore provided inside a container, is compressed between a closure base of the container and a fixed rammer pierced with an axial orifice and equipped at its end with a block carrying a die and capable of entering inside the bore via displacement of the container and its base under the action of a main extrusion jack so as to produce, by extruding the metal in the die, extrusion of a bar which is discharged via the axial orifice of the rammer.

According to the invention, a billet is directly extruded in the raw state, leaving sufficient play between the periphery of the die-holder block and the inner face of the bore, to form, during extrusion, a sleeve, having a thickness at least equal to that of the outer layer, along the inner face of the bore, which sleeve is likely to contain surface to defects. The bore is then scraped, using a scraping block whose periphery is separated from the inner face of the bore by a play which is less than the thickness of the sleeve but sufficient to remove the latter over only a part of its thickness, leaving, after scraping, a metal film with a uniform thickness covering all the inner face of the bore.

The play left between the periphery of the dieholder block and the inner face of the housing is determined as a function of the diameter of the billet and may be between 1.5 mm and 4 mm depending on the diameter. The play left between the periphery of the scraping block and the inner face of the bore may be between about 0.1 and 0.25 mm, approximately.

It is particularly advantageous that, during loading of the billet in the container, the billet is held perfectly centered on the axis of the bore so that there is no risk of the film left during the earlier extrusion being damaged during loading.

To this end, according to a further known method, the billet is first placed exactly in the extruding axis and is clamped between the die-holder block and the closure base, the container then being introduced by being slid over the billet.

The invention also relates to a press for carrying out such a method and which, being provided for extruding using the reverse method, comprises a fixed rammer pierced with an axial orifice and over which slides the bore of a container in which the billet to be extruded has been placed, the billet being compressed between the closure base of the container and a die-holder block located at the end of the rammer. The press also comprises a means for cleaning the bore after extrusion comprising a scraping block mounted on a rammer that can be introduced into the extrusion axis so as to enter the housing after extrusion.

According to the invention, the die-holder block has a diameter which is substantially less than that of the inner face of the bore so that, between the latter and the periphery of the die-holder block, there is a first play which is at least equal to the thickness of the outer layer to be removed, in order to form a sleeve with a thickness sufficient to contain this outer layers and the scraping block has a diameter which is slightly less than that of the inner face of the bore so that there is, between the latter and the periphery of the scraping block, a second play which is less than the first but sufficient for the sleeve to be scraped over its inner face over a part only of its thickness, leaving, after scraping, a metal film with a uniform thickness covering all the inner face of the bore.

Preferably, the scraping block is mounted on a second rammer which can be placed in the extrusion axis and can be introduced into the housing of the container via axial displacement in a scraping direction and withdrawn in the opposite direction. According to another essential feature of the invention, the scraping block is connected to the second rammer so that it remains fixed to the end of the latter both in the scraping direction and in the withdrawal direction, and it has a variable diameter such that the play left between the periphery of the scraping block and the inner face of the housing is smaller in the scraping direction than in the withdrawal direction.

To this end, the scraping block preferably comprises a support body fixed to the end of the scraping rammer and carrying, on the side opposite the rammer, a scraper segment in the form of a resilient ring cut by a slot centered in a radial plane and limited by two plane faces opening inwards in a V, and between which engages an expansion wedge provided with support faces of corresponding inclination, and mounted so as to slide transversely over the support body, the latter being connected to means for controlling a transverse displacement of the wedge towards the outside in order to determine the widening of the slot and the increase in the diameter of the scraper segment.

The scraper segment is advantageously provided on its periphery, with a cutting edge for planing the sleeve and, via a smooth face perpendicular to the axis of the rammer, it rests on a corresponding smooth face provided at the end of the support body opposite the rammer. Moreover, the scraper segment is rigidly fixed in axial displacement to the support body via a retaining flange in the form of a ring having a U-shaped section and comprising two wings which engage respectively in corresponding circular grooves provided on the segment and on the support body, the said flange being cut by a slot at the level of the slot in the segment.

In a preferred embodiment, the means for controlling the transverse displacement of the expansion wedge comprise an operating rod mounted so as to slide axially inside the support body and over which is provided a cam comprising a plane face which is inclined with respect to the axis of the support body and which interacts with a plane face of corresponding inclination provided on the expansion wedge so as to control the transverse displacement of the latter outwards via axial displacement of the maneuvering rod.

BRIEF DESCRIPTION OF THE DRAWINGS

The invention will be better understood by means of the following description of a particular embodiment, given by way of example and represented in the appended drawings.

FIG. 1 is a schematic plan view of a conventional extrusion press which operates using the reverse method.

FIG. 2 shows, in partial half-section, a billet in the raw state;

FIG. 3 shows, in partial half-section, a billet loaded in the container and after compression;

DESCRIPTION OF PREFERRED EMBODIMENT

Figure 4:
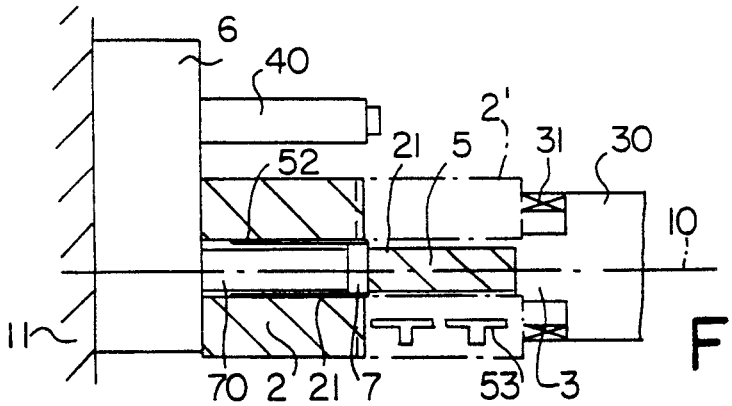
FIGS. 4 to 11 show diagrammatically the various stages in extruding a billet with scraping of the container.

By way of example, FIG. 1 shows the essential components of an extrusion press using the reverse method, comprising a supporting beam 11 and a fixed crossbeam 12 connected together via columns 13 and between which are mounted, for sliding movement parallel to the extrusion direction, a container 2 and a movable crossbeam 30 activated by a main extruding jack 14 resting on the fixed crossbeam 12. Auxiliary jacks 15 and 16 make it possible to operate, respectively, the movable crossbeam 30 and a crossbeam 20 carrying the container 2, without activating the main jack 14.

The container 2 is pierced with a cylindrical bore 21 which is centered on an extrusion axis 10 and can be closed at one end by means of a base 3 carried by the movable crossbeam 30.

A rammer 40 consisting of a tubular column carrying at its free end an extruding block 4 carrying a die 41 rests on the supporting beam 11. The die 41 opens over a bore 42 provided in the axis of the rammer 40 and extended via a discharge duct 17 which passes through the supporting beam 11. The entire assembly is centered on the axis of the bore 21 which constitutes the extrusion axis 10.

The principle of reverse extruding is known. A metal billet 5 to be extruded is placed inside the bore 21 of the container 2 which is closed on one side by the base 3 carried by the movable crossbeam 30. When the main jack 14 pushes the movable crossbeam 30 towards the supporting beam 11, moving the container, the billet 5 is compressed between the container base 3 and the die 41 carried by the extruding block 4 over which the bore 21 of the container moved by the movable crossbeam 30 is progressively introduced. This results in the extrusion of the metal of the billet 5 which forms a profile discharged by the aligned ducts 42 and 17.

The reverse extrusion process is well known and is the subject of numerous improvements.

In particular, in the embodiment shown in FIG. 1, the press is equipped with a cutter 23 mounted for sliding movement along the rear face of the container 2 and with adjustable stops 61 to limit the advance of the container. Moreover, the extrusion rammer 40 is associated with a second rammer 70 which is laterally offset and carries a scraping block 7. The two rammers are fixed on a support 6 mounted for sliding movement over the inner face of the supporting beam 11 and are activated by a jack 62 which makes it possible to place in the extrusion axis 10 one or the other of the two rammers 40 and 70.

After extrusion, there usually remains, along the inner face of the bore 21, a thin sleeve of metal which has passed between the said inner face and the periphery of the extrusion block 4, and which is connected to the metal remainder remaining between the extrusion block 4 and the container base 3.

After cutting of the remainder, the container 2 is withdrawn, the second rammer 70 is placed in the extrusion axis and the container is advanced again. The scraping block 7, which has a diameter equal to that of the housing 21, is introduced into the latter by pushing back the metal sleeve for deslagging the inner face of the bore 21.

The invention uses such arrangements but adapts them so that it becomes possible to use crude billets in extrusion.

FIG. 2 shows, in partial half-section, and on an enlarged scale, a billet 5 in the crude state. On its periphery, the latter comprises surface defects which may be found over an outer layer 54 of thickness (a).

Besides , the lateral wall 55 of the billet is not perfectly smooth or straight. To remove all these defects, by peeling or scalping, it is necessary to reduce the diameter of the billet 5 over a thickness (b).

FIG. 3 shows the billet 5 after compression in the bore 21 in container 2. As may be seen, the method according to the invention makes it possible to reduce the diameter of the billet 5 only over a thickness (a') which is substantially equal to the thickness (a) of the outer layer 55 which may contain defects.

The operation of the various components for implementing the invention is shown in detail on an enlarged scale in FIGS. 4 to 11, which show the various stages of the method.

These figures show only the components located between the supporting beam 11 and the movable crossbeam 30.

FIG. 4 shows the introduction into the container 2 of a new billet 5 which, as has been indicated, is used in the crude state. In a particularly advantageous manner for embodying the invention, use is made to this end of a known method, the so-called billet clamping process. The loading operation starts after deslagging of the container, i.e., after introduction of the container 2 over the rammer 70 carrying the scraping block 7. The movable crossbeam 30 has been separated from the container by a distance greater than the length of the billet and a new billet 5 has been brought into the extrusion axis by means of a loading shovel 53 which positions the billet 5 between the scraping block 7 and the container base 3 so that it is exactly centered on the extrusion axis 10. By controlling the approach of the movable crossbeam 30, the billet 5 is clamped between the container base 3 and the scraping block 7 in the position shown in FIG. 4. It is then possible to withdraw the loading shovel 53 without risk of the billet being displaced, then to withdraw the container 2 towards the movable crossbeam 30 by means of its operating jacks 16 so that the bore 21 of the container is introduced over the billet 5. This introduction may be performed easily and without the billet coming into contact with the wall 21 of the bore, since it is held centered and gripped between the block 7 and the container base 3.

After this displacement, the container 2', shown in dot-dash lines in FIG. 4, comes up against stops 31 of the movable crossbeam 30. The billet 5 is then completely introduced into the bore 21.

Figure 5:
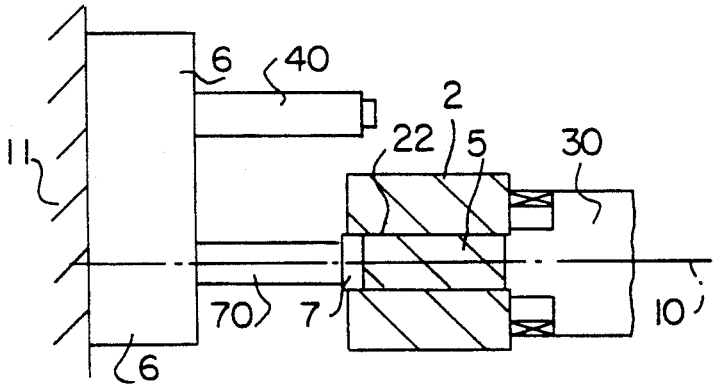

As shown in FIG. 5, the billet is then compressed inside the bore 21 by applying considerable pressure on the movable crossbeam 30. The billet 5, compressed between the base 3 and the scraping block 7, is slightly reduced in length while its diameter increases and its peripheral surface is firmly pressed against the inner face 22 of the boring 21.

Figure 6:
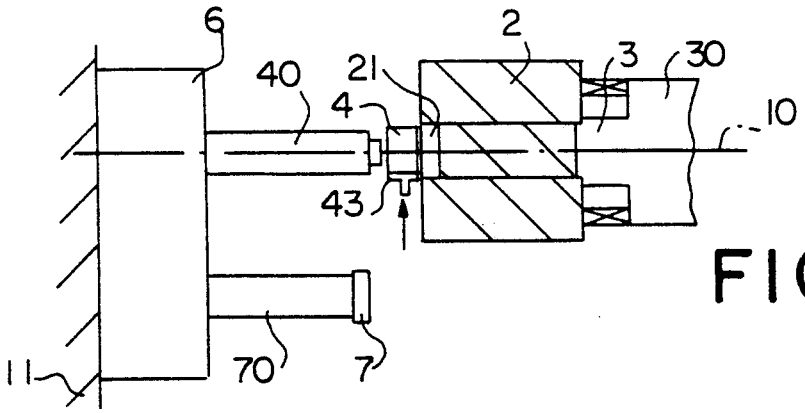

The movable crossbeam 30 with the container 2 may then be withdrawn in order to release the scraping block 7 and then to control, by means of the jack 62, a translational movement of the support 6 which engages the tubular rammer 40 in the extrusion axis 10 in the position shown in FIG. 6. Normally, the die and the extruding block used during the above extrusion have been removed with the remainder, and a new extruding block must be mounted on the rammer 40.

To this end, a new extruding block 4 is placed opposite the rammer 40 by means of a loading component 43, and a further advance of the movable crossbeam 30 towards the supporting beam 11, which moves the container 2 and the extruding block 4, is then command. The extruding block is pressed on one side against the billet 5, and on the other side, it is introduced over a suitable support provided at the end of the rammer 40.

Figure 7:
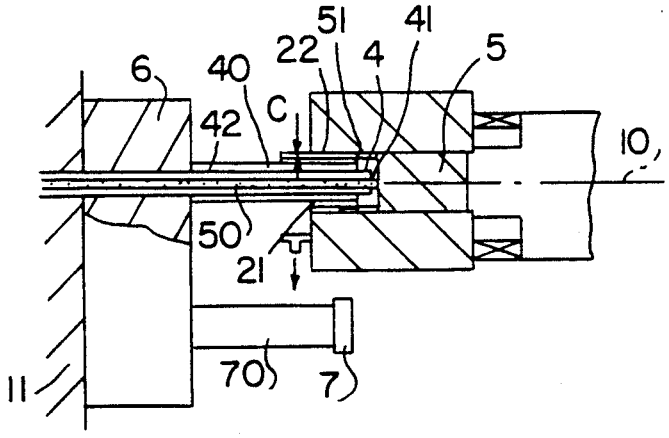

Extrusion may then commence, the billet 5 being compressed between the container base 3 and the block 4, which carries the die 41. FIG. 7 shows extrusion in progress and it may be seen, in particular, how the profiled bar 50, which is discharged via the axial orifice 41 of the rammer 40, is formed.

According to the invention, the die-holder block 4 is given an outer diameter (D1) which is markedly less than that (D2) of the inner face 22 of the bore 21. In this manner, a metal sleeve 51, whose thickness is particularly large and which corresponds substantially to the play (C) left between the periphery of the block 4 and the inner face (22) of the bore 21, is formed along the latter. In practice, this play (C) is calculated so that the thickness (a') of the sleeve 51 thereby formed is at least equal to the thickness (a) of the outer layer (54) of the billet (5) likely to contain surface defects. This thickness (a) to be removed may be between 1 and 4 mm, depending on the diameter of the billet.

The thickness (a') of the sleeve will therefore be determined in this gap as a function of the diameter of the billet and it will be observed that it may be substantially less than the thickness (b) of metal which had to be removed in conventional methods and which could range up to 10 mm. In fact, in prior art techniques, this removal is performed before the billet is introduced in the housing, and it is therefore necessary to take into account not only the depth (a) up to which surface defects may be found, but also surface defects and straightness defects of the billet. In the method according to the invention, on the contrary, a billet in the crude state is introduced into the bore 21; consequently, the outer face 55 of the billet may not be smooth or straight, but this is not a drawback since, by virtue of the clamping process, the billet 5 is perfectly centered during its introduction into the container 2 and the compression carried out subsequently makes it possible to press the periphery of the billet exactly against the inner face 22 of the bore 21. In this manner, as may be seen in FIG. 3, the outer layer 55 to be removed in turn becomes straight and its thickness (a') depends only on the size of the surface defects and the thickness of a metal film 52, which will be discussed below. This constitutes a first advantage of the invention.

The sleeve 51 thereby formed along the bore 21 has, however, a thickness which is much greater than that which usually forms, and as a result the annular section of metal contained between the periphery of the block 4 and the bore 21 becomes closer to any may even exceed the section of the bar extruded via the die 41. Any apprehension that the metal might then not be extruded preferably via the periphery is overcome by another feature of the invention, discussed below.

Figure 8:
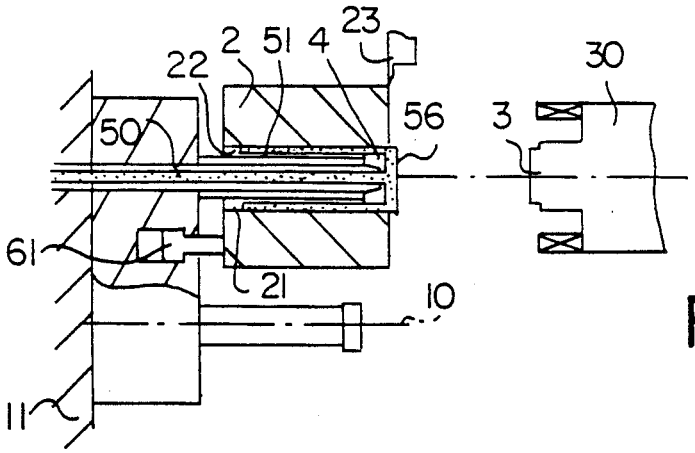

After extrusion, a metal remainder 56, whose central part is connected to the extruder bar 50 and whose periphery is connected to the sleeve 51, remains between the die-holder block 4 and the base 3. According to a known process, after withdrawal of the movable crossbeam and the base 3, the container 2 is advanced up to the adjustable stops 61 whose advance is determined, as shown in FIG. 8, such that, when the container 2 comes into abutment against them, its rear face is in alignment with the front face of the die-holder block 4 beyond which only the remainder 56 extends. A cutter 23 which cuts the remainder 56, separating it from the bar 50 and the sleeve 51, is then moved along the rear face of the container. The remainder 56 and the bar 50 are then discharged and the bore 21 then contains only the thick sleeve 51.

Figure 9:
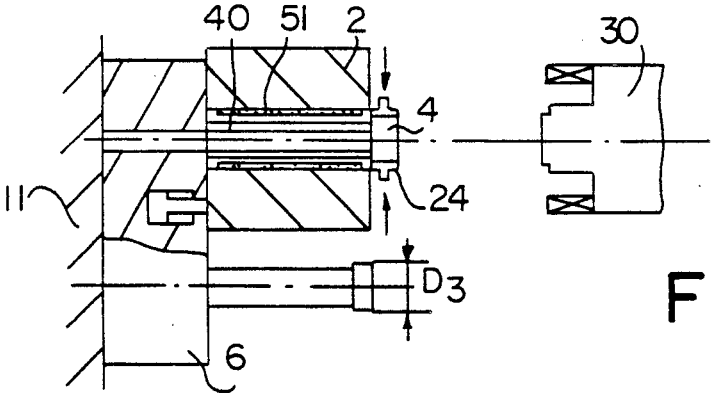

As shown in FIG. 9, the stops 61 are then withdrawn and the container 2 is advanced so as to release the extruding block 4, which may be withdrawn by means of a recovery shovel 24.

Figure 10:
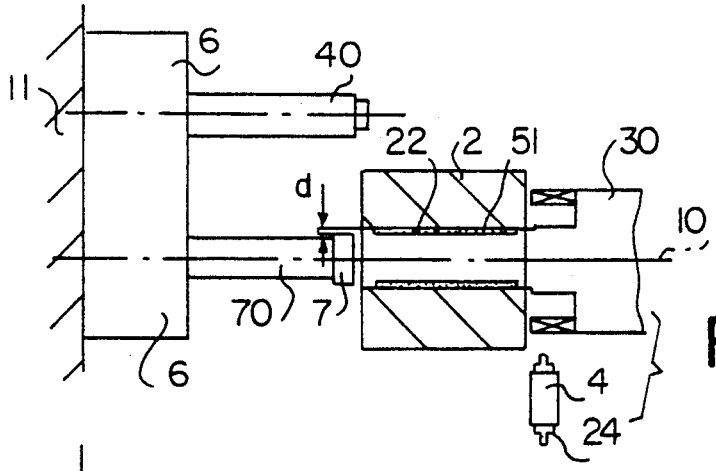
Figure 11:
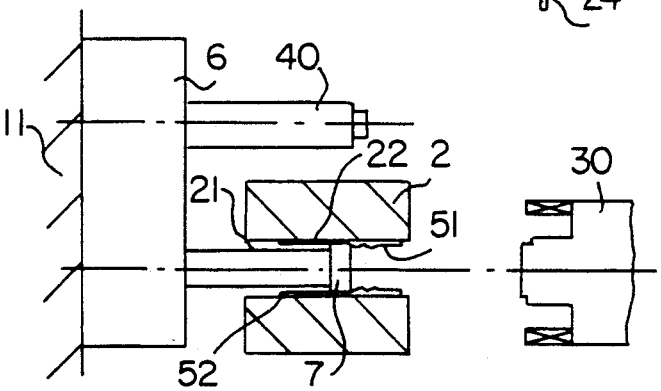

Since the extruding rammer 40 is thereby released from the block it carried, there is no risk of damaging the thick sleeve 51 by advancing the container 2 again in order to arrive in the position shown in FIG. 10, which also shows the discharge of the extruding block 4.

The scraping block 7 mounted on the second rammer 70 is then introduced into the extruding axis 10 via a translational movement of the support 6.

The scraping block 7, which will be described in detail below, is connected to its rammer 70 and is extendable so as to have a diameter which is greater in the scraping direction than in the withdrawal direction. In the scraping position, the diameter of the block 7 is, in fact, slightly smaller than the diameter of the bore 21 so that a play (d), which may be, for example, between 0.1 and 0.25 mm depending on the circumstances, exists between the periphery of the block 7 and the inner face of the bore 21.

This play (d) is therefore greater than the simple sliding play which is usually left between the scraping block and the inner face of the bore and which it is normally attempted to reduce to a minimum so that the scraping block completely cleans the bore. In the invention, on the other hand, the scraping block 7 does not totally push the sleeve 51 back outside the bore but only planes its inner part leaving a metal film 52 whose thickness therefore corresponds substantially to the second play (d) left between the scraping block and the lateral wall of the bore remaining along the inner face 22 of the bore. This play (d) will be determined in particular by taking into account the nature of the metal, so that there is no risk of the film thereby left tearing upon scraping and, on the contrary, it entirely covers the lateral wall of the bore 21.

After scraping, the container 2 therefore completely surrounds the rammer 70 in the position shown in FIG. 4, and the cycle may be recommenced by introducing a new billet 5 between the scraping block 7 and the container base 3.

When the clamping process is used for loading the billet, the latter is perfectly centered on the extrusion axis. Moreover, by exerting the necessary clamping pressure on the billet 5 in order to hold it, it is possible, by means described below, to control a reduction in the diameter of the scraping block 7 when the container is withdrawn after scraping, so that there is no risk of the withdrawal of the scraping block 7 damaging the film 52 left along the lateral wall of the housing. Moreover, the scraping block 7 is connected to its rammer 70, which enables it to be held exactly in the axis of the bore both in the scraping direction and in the withdrawal direction. Therefore, there is no risk of the block resting on the base of the the bore 21 and the film 52 formed during the scraping has a perfectly uniform thickness.

When a new billet to be extruded is introduced into the bore thereby covered with a metal film 52, and when compression is performed, this operation actually welds the lateral face 55 of the billet 5 to the film 52. It has been observed that, during extrusion, the presence of this film 52 which adheres perfectly, on one side, to the inner face 22 of the bore 21 and, on the other side, to the lateral face 55 of the billet 5, forms an actual seal in opposition to the preferred extrusion, via the peripheral play (c), which could arise when the section through which the die passes is of the same order as the annular section left by the play (c). Moreover, because the film 52 has a constant thickness in all directions, it perfectly centers the billet and therefore perfectly centers the flow of metal into the bar or the extruded tube.

Figure 12:
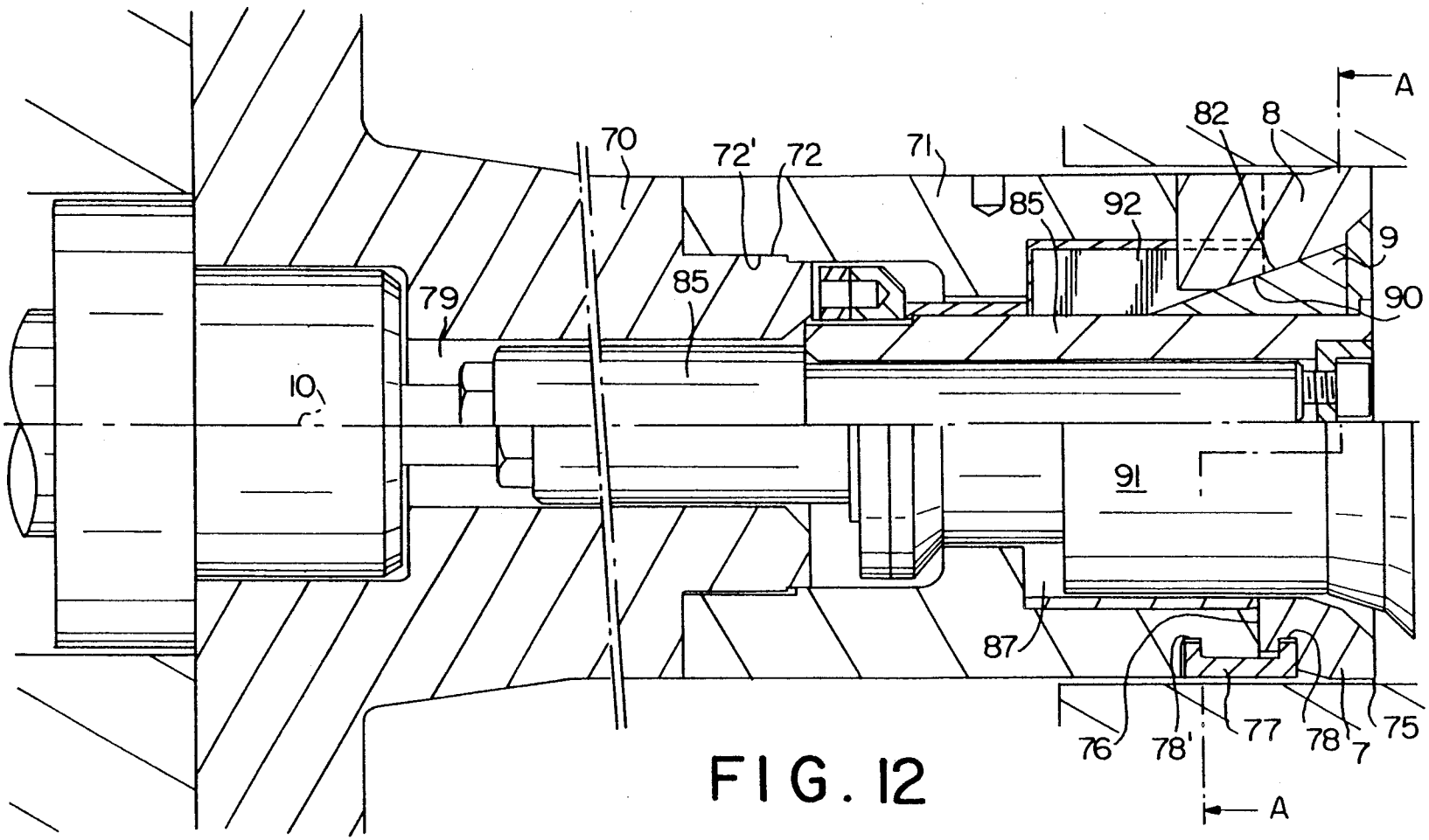
FIG. 12 is a view in axial section of the scraping block represented in extended position in the top half-view and in retracted position in the bottom half-view.
Figure 14:
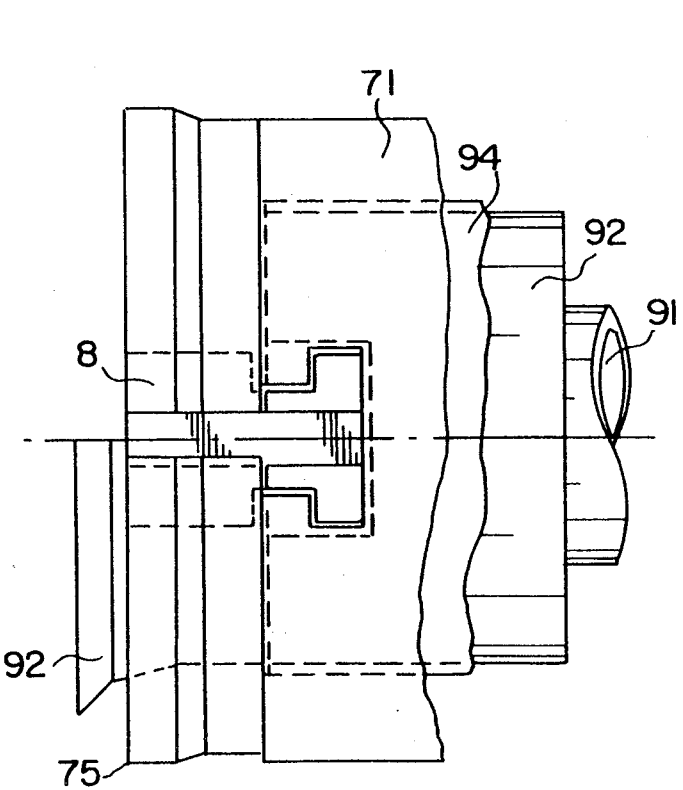
FIG. 14 is a plan view of the scraping block with partial sections.
Figure 13:
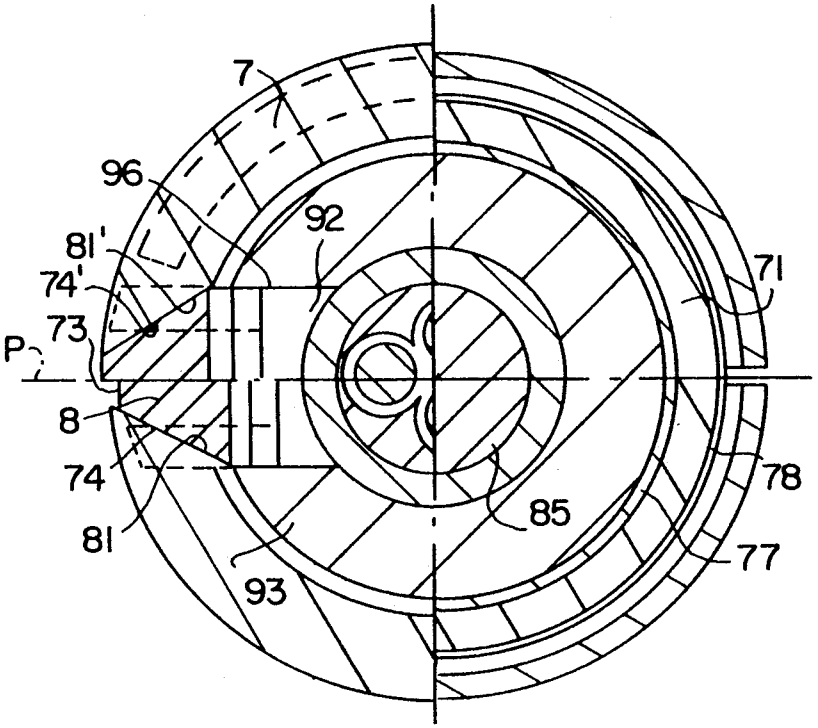
FIG. 13 is a view in transverse section along the line A—A of FIG. 12.

In order to extend and contract the scraping block 7, it is advantageous to perform the latter in the manner indicated in FIGS. 12 to 14 which are, however, given only by way of example, as it is clearly possible to use other embodiments to obtain the same result.

FIG. 12 shows, in longitudinal section, the scraping block in its two positions, in an extended position in the top half-section and in a contracted position in the bottom half-section, respectively. In the same manner, FIG. 13, which is a view in transverse section along the line A—A of FIG. 12, and FIG. 14, which is a plan view, shows the block 7 in extended position in the lower part and in a contracted position in the upper part.

As may be seen in FIG. 12, the scraping block consists essentially of a segment 7 mounted on the end of a tubular body 71 having, on the rammer 70 side, a threaded bore 72 which engages with a corresponding thread 72' on the rammer 70.

The segment 7 consists of a resilient ring cut by a slot 73 centered in a radial plane $P_1$ passing through the axis of the rammer and limited by two plane faces 74, 74' inclined symmetrically with respect to the plane $P_1$ so as to open inwards in a V.

The scraper segment 7 is, moreover, provided, on the side opposite the rammer 70, with a cutting edge 75' and rests, via a smooth face 76, on the end of the support body 71 to which it is joined in axial displacement via a retaining flange 77 having a U-shaped section comprising two wings engaging respectively in corresponding circular grooves 78, 78' provided on the segment 7 and on the support body 71, respectively, and whose depth is determined so as to leave a radial play which permits a slight variation in diameter of the segment 7. The retaining flange 77 is advantageously produced in two parts placed on either side of the plane P and whose ends 77' are separated by a free space at the level of the slot 73 of the segment 7.

The variation in diameter of the segment 7 is controlled by an expansion wedge 8 which is placed between the two end faces 74, 74' of the scraping segment 7 on which it rests via faces 81, 81', which have the same inclination. In this manner, a radial displacement outwards or inwards of the wedge 8 determines the expansion or, respectively, the contraction of the segment 7.

To this end, the wedge 8 is inwardly provided with a plane face 82 inclined with respect to the axis 10 of the rammer and interacting with a face 90 of the same inclination arranged on a cam 9 against which the wedge 8 is pressed inwards as a result of the resilience of the segment 7 and the V inclination of the faces 74, 74'.

The cam 9 is fixed on a control member 91 provided with an enlarged part 92 which may slide axially in a bore 93 provided in the support body 71 along a guide ring 94 ensuring slight sliding. The cam 9 is located in a longitudinal groove 95 provided in the enlarged part 92 and limited by two plane faces 96, 96' along which lateral faces 85, 85' may slide for radially guiding the expansion wedge 8.

The control member 91 is introduced and fixed on an operating rod 97 mounted so as to slide in an axial bore 79 of the rammer 70 and connected to the rod of a jack 98 housed in the support 61.

In this manner, as may be seen in longitudinal section in FIG. 12 and in transverse section in FIG. 13, the axial displacement of the control piece 91 under the action of the jack 98 determines, by means of the wedge 8, the expansion or the contraction of the scraper segment 7, the outer profile of the expansion wedge 8 being determined so as to ensure the continuity of the two branches of the scraping segment 7 in an expansion position 8. In the same manner, in the expansion position, the front faces of the wedge 8, of the segment 7 and of the operating member 91 are located in one and the same plane P2 perpendicular to the axis 10 so as to form a smooth face 86 for compressing the billet.

Of course, this embodiment of the scraping block has been described only by way of a preferred example, it being possible for other arrangements to be used in order to produce an expandable block connected to its rammer.

Similarly, in order to ensure replacement of the extruding block by the scraping block, use could be made of arrangements other than the mounting, known from elsewhere, of two rammers on one and the same sliding support which has been described above to illustrate the invention.

What we claim is:

1. Method for extruding a billet (5) of metal in an extrusion press, said billet (5) comprising, in the raw state, an outer layer (54) of a thickness (a) likely to contain surface defects, said press comprising:

a die (41) mounted on an extrusion block (4) at a first end of a fixed rammer (40) having first and second ends and pierced with an orifice (42), said die resting adjacent said second end of said fixed rammer on a supporting beam (11), said die (41) and said orifice (42) being centered on an extrusion axis (10);

a container (2) having a cylindrical bore (21) centered on said extrusion axis (10), said container (2) resting on a movable crossbeam (30) carrying a closure base (3) for said bore (21);

means (53) for loading a metal billet (5) to be extruded in said bore (21);

at least one jack (14) for displacing said movable crossbeam (30) and said container (2) towards said fixed rammer (40), so as to produce a bar by extruding in said die a metal billet (5) placed in said bore (21); and means for scraping said bore (21) after extrusion, said means comprising a scraping block (7) mounted on a second rammer (70) and being adapted to be introduced into said bore (21);

said method comprising the steps of:

(a) mounting on said fixed rammer (40) an extrusion block (4) having an outer diameter (D1) which is less than a diameter (D2) of said bore (21), thereby leaving a play (c) between a periphery of said extrusion block (4) and said bore (21);

(b) placing said billet (5) in said bore (21), said billet (5) being in its raw state without prior removal of said outer layer (54);

(c) extruding said raw billet (5) by displacing said movable crossbeam (30) towards said fixed rammer (40), for producing a bar (50) which is discharged via said orifice (42) of said rammer (40);

(d) forming during extrusion a sleeve (51) having a thickness (a'), said play (c) being calculated so that said thickness (a') is at least equal to the thickness (a) of said outer layer (54);

(e) mounting on said second rammer (70) a scraping block (7) having an outer diameter (D3) which is less than said diameter (D2) of said bore (21) for leaving a play (d) between a periphery of said scraping block (7) and said bore (21), said play (d) being less than a thickness (a') of said sleeve (51); and (f) scraping said bore (21) by said scraping block (7) over only a part of the thickness of said sleeve (51) and leaving, after scraping, a metal film (52) having a uniform thickness covering all the inner face (22) of said bore (21).

2. Method according to claim 1, wherein the play left between the periphery of said extruding block (4) and the inner face (22) of said bore (21) is determined as a function of a diameter of said billet and is between 1.5 and 4 mm.

3. Method according to claim 1 or 2, wherein a play between 0.1 and 0.25 mm is left between the periphery of said scraping block (7) and the inner face (22) of said bore (21).

4. Method according to claim 1 or 2, wherein, in order to load said billet (5) in said container (2), the billet is held perfectly centered on the axis (10) of said bore (21) so as to preclude damage to said film (52) during loading.

5. Method according to claim 4, wherein, in order to be loaded in the container (2), said billet (5) is first placed exactly in the extruding axis and is clamped between said scraping block (7) and said closure base (3), said container (2) then being introduced over said billet (5) by means of axial sliding.

6. Method according to claim 1 or 2, applied to the extrusion of aluminum and alloys thereof.

7. Extrusion press for extruding a billet of metal for producing a bar, said billet comprising, in the raw sate an outer layer (54) of a certain thickness (a) likely to contain surface defects, said press comprising (a) a die (41) mounted on an extrusion block (4) at a first end of a fixed rammer (40) having first and second ends and pierced with an orifice (42), said die resting adjacent said second end of said fixed rammer on a supporting beam (11), said die (41) and said orifice (42) being centered on an extrusion axis (10);

(b) a container (2) having a cylindrical bore (21) centered on said extrusion axis (10), said container (2) resting on a movable crossbeam (30) carrying a closure base (3) for said bore (21);

(c) means (53) for loading a metal billet (5) to be extruded in said bore (21);

(d) at least one jack (14) for displacing said movable crossbeam (30) and said container (2) towards said fixed rammer (40), so as to produce a bar by extruding in said die a metal billet (5) place din said bore (21); and (e) means for scraping said bore (21) after extrusion, said means comprising a scraping block (7) mounted on a rammer (70) and being adapted to be introduced in said bore (21);

(f) wherein said extrusion block (4) has an outer diameter (D1) which is less than a diameter (D2) of said bore (21) for leaving a play (c) between the periphery of said extrusion block (4) and said bore (21), in order to form, during extrusion, a sleeve (51) having a thickness (a'), said play (c) being calculated so that said thickness (a') is at least equal to the thickness (a) of said outer layer (54); and (g) wherein said scraping block (7) has an outer diameter (D3) which is slightly less than the diameter (D2) of said bore (21) so as to leave a play (d) between the periphery of said scraping block (7) and said bore (21), said play (d) being less than the thickness (a) of said sleeve (51), but sufficient for said sleeve (51) to be scraped inwards and over a part only of its thickness, leaving, after scraping, a metal film (52) having a uniform thickness covering the entire inner face (22) of said bore (21).

8. Extrusion press according to claim 7, wherein said play (c) between the extruding block (4) and the inner face (22) of the bore (21) is determined as a function of the diameter of the billet in a range from about 1.5 to about 4 mm.

9. Extrusion press according to claim 7 or 8, wherein said play (d) between the scraping block (7) and the inner face (22) of the bore (21) is in the range form 0.1 to 0.25 mm.

10. Extrusion press according to claim 7 or 8, wherein the scraping block (7) is mounted on a second rammer (70) which is placed in the extrusion axis (10) and introduced into the bore (21) of the container (2) via axial displacement in a scraping direction and withdrawn in the opposite direction, wherein the scraping block (7) is connected to said second rammer (70) so that it remains fixed to the end of said rammer in both the scraping direction and the withdrawing direction, and wherein it has a diameter (D3) which is variable such that the second pay (d) between the periphery of sad scraping block (7) and the face (22) of said bore (21) is smaller in the scraping direction than in the withdrawal direction.

11. Extrusion press according to claim 10, wherein said scraping block (7) comprises a support body (71) fixed to an end of said second rammer (70) and carrying, on a side opposite said second rammer, a scraper segment (7') in the form of a resilient ring cut by a slot (73) centered in a radial plane ($P_1$) and delimited by two plane faces (74, 74') diverging inwardly to form a V, and an expansion wedge (8) engaging therebetween having support faces (81, 81') of corresponding inclination and mounted so as to slide transversely over said support body (71), said support body being associated with means (9) for controlling a transverse displacement of said wedge (8) towards an exterior so as to determined widening of said slot (73) and increase in diameter of said scraper segment (7').

12. Extrusion press according to claim 11, wherein said scraper segment (7') has a cutting edge (75) on its periphery for planing said sleeve (51) and a smooth face perpendicular to an axis of said second rammer (70) resting on a corresponding smooth face (76) provided at an end of said support body (71) opposite said second rammer (70), said scraper segment (7') being joined in axial displacement to said support body (71) by means of a retaining flange (77) in the form of a ring having a U-shaped section and comprising two wings which engage respectively in corresponding circular grooves (78, 78') provided on said scraper segment (7') and on said support body (71), respectively, said flange (77) comprising two opposing ends (77') separated by a space corresponding to said slot (73) of said scraper segment (7').

13. Extrusion press according to claim 11, wherein the means for controlling transverse displacement of said expansion wedge (8) comprise a cam (9) having a lane face (90) which is inclined with respect to said axis (10) and interacts with a plane face (82) of corresponding inclination provided on said expansion wedge (8), said cam (9) being fixed on a control member (91, 92) mounted on an operating rod for sliding movement in an axial bore (93) of said support body (71) so as to control outward transverse displacement of said support body by axial displacement of said operating rod.

14. Extrusion press according to claim 13, wherein said expansion wedge (8) is mounted for transverse sliding movement in a slot (95) provided in an enlarged part (92) of said control member (91) and limited by two plane faces (96, 96') parallel to said axis (10) and interacting with corresponding lateral faces (85, 85') of said expansion wedge (8).

15. Extrusion press according to claim 13, wherein said control member (91, 92) is driven by an operating rod (97) mounted for sliding movement in an axial bore of said second rammer (70) and connected to a rod of a jack (98) controlling axial sliding.

* * * * *

UNITED STATES PATENT AND TRADEMARK OFFICE

CERTIFICATE OF CORRECTION

PATENT NO. : 4,989,437

DATED : February 5, 1991

INVENTOR(S) : Bessey et al

It is certified that error appears in the above-identified patent and that said Letters Patent is hereby corrected as shown below:

Column 10, line 61, change "din" to --in--.

Column 11, line 24, change "form" to --from--.

Column 11, line 36, change "pay" to --play--.

Column 11, line 36, change "sad" to --said--

Column 12, line 27, change " lane" to --plane--.

Signed and Sealed this

Twenty-sixth Day of January, 1993

*Attest:*

STEPHEN G. KUNIN

*Attesting Officer*

*Acting Commissioner of Patents and Trademarks*